US006575343B2

(12) United States Patent
Mossman

(10) Patent No.: US 6,575,343 B2
(45) Date of Patent: Jun. 10, 2003

(54) FULL SIZE SERVICE HANDGUN HOLSTER AND MOUNTING BRACKET ASSEMBLY

(76) Inventor: Richard Lee Mossman, 7979 230th St. Lane North, Forest Lake, MN (US) 55025

( * ) Notice: Subject to any disclaimer, the term of this patent is extended or adjusted under 35 U.S.C. 154(b) by 91 days.

(21) Appl. No.: 10/032,624

(22) Filed: Oct. 24, 2001

(65) Prior Publication Data

US 2003/0075574 A1 Apr. 24, 2003

(51) Int. Cl.[7] ..... F41C 33/04

(52) U.S. Cl. ..... 224/198; 224/197; 224/238; 224/240; 224/271; 224/911; 248/222.52

(58) Field of Search ..... 224/196, 197, 224/198, 199, 238, 240, 243, 271, 665, 677, 911, 912; 249/222.51, 222.52

(56) References Cited

U.S. PATENT DOCUMENTS

| | | | | |
|---|---|---|---|---|
| 3,858,996 A | * | 1/1975 | Jarvis | 248/222.52 |
| 3,915,361 A | | 10/1975 | Perkins | |
| 3,955,724 A | | 5/1976 | Perkins | |
| 4,286,741 A | | 9/1981 | Rogers | |
| 4,504,001 A | | 3/1985 | Nichols | |
| 4,694,980 A | | 9/1987 | Rogers | |
| 4,905,880 A | | 3/1990 | Cupp | |
| 4,925,075 A | | 5/1990 | Rogers | |
| 5,018,653 A | | 5/1991 | Shoemaker | |
| 5,018,654 A | | 5/1991 | Rogers et al. | |
| 5,067,642 A | * | 11/1991 | Fodge | 224/911 |
| 5,100,036 A | | 3/1992 | Rogers et al. | |
| 5,167,355 A | | 12/1992 | Hill | |
| 5,201,447 A | | 4/1993 | Bumb et al. | |
| 5,265,781 A | | 11/1993 | Nichols | |
| 5,269,448 A | | 12/1993 | Shoemaker | |
| 5,372,288 A | | 12/1994 | Rogers et al. | |
| 5,419,472 A | | 5/1995 | Hellweg et al. | |
| 5,551,610 A | | 9/1996 | Clifton, Jr. | |
| 5,551,611 A | * | 9/1996 | Gilmore | 224/198 |
| 5,598,958 A | | 2/1997 | Ryan, III et al. | |
| 5,632,426 A | | 5/1997 | Beletsky et al. | |
| 5,641,102 A | | 6/1997 | Hellweg | |
| 5,722,576 A | * | 3/1998 | Rogers | 224/271 |
| 5,875,944 A | | 3/1999 | Beletsky | |
| 5,931,358 A | | 8/1999 | Rogers | |
| 6,041,444 A | | 3/2000 | McKinney | |
| 6,092,703 A | | 7/2000 | Johnson | |
| 6,161,741 A | * | 12/2000 | French | 224/198 |
| 6,189,751 B1 | * | 2/2001 | Tserng | 224/243 |
| 6,467,660 B1 | * | 10/2002 | Rogers et al. | 224/238 |

FOREIGN PATENT DOCUMENTS

| | | |
|---|---|---|
| BE | 843303 | 12/1976 |
| CH | 635421 | 3/1983 |

* cited by examiner

*Primary Examiner*—Gary E. Elkins
(74) *Attorney, Agent, or Firm*—Michael A. Mochinski

(57) ABSTRACT

An improved holster and mounting bracket assembly made adaptable for use by law enforcement personnel as well as other professionals whom are required to wear for sustained periods of time a handgun, particularly those of the full size service type. The holster generally comprises a handgun pouch having front and back walls substantially symmetrical and parallel to one another, with the walls being held together by a barrel pad and a trigger guard support, a pair of extending straps each being fitted with a snap fastening button to secure the handgun within the handgun pouch, and a push/pull loop integrally made part of the handgun pouch to permit adjustment of the holster without resorting to increased handling of components comprising the handgun. The mounting bracket assembly generally includes belt mounting and receiving plates for securing the holster to a belt or strap and a swivel plate fixedly attached to the back wall of the handgun pouch to serve as means to adjust the angular orientation of the holster to aid in added comfort and rapid retrieval of the handgun from the wearer.

21 Claims, 9 Drawing Sheets

FULL SIZE SERVICE HANDGUN HOLSTER AND MOUNTING BRACKET ASSEMBLY

FIELD OF THE INVENTION

The present invention relates to an improved holster and mounting bracket assembly for holding and supporting a full size service handgun on a user. More particularly, the present invention relates to an improved holster and mounting bracket assembly having the capability of being configured for quick and efficient retrieval of the handgun from the person, while providing a level of complete concealability and comfort to the wearer.

BACKGROUND OF THE INVENTION

The prior art describes many types of holsters having various shapes and sizes to accommodate the unique configuration of the handgun, but many lack the capacity to completely store and conceal a full size service handgun that is often used by today's law enforcement personnel. Holsters described in the art include those that can be attached to the waistline or leg using a belt of some type or attached to the wearer using a harness comprised of prearranged straps fitted around the wearer's chest and back. Most, if not all, prior art devices demonstrate that the positioning of the handgun near the waistline is the optimum location for rapid withdraw of the handgun, which is particularly important to law enforcement personnel during a crisis or in an emergency situation. The ability to efficiently withdraw the handgun from the holster, particularly those of the full service type, is greatly improved if the holster includes means for ready adjustment to permit proper orientation thereof in relation to the wearer's arm and corresponding movement. Further, the ability to adjust the angle of the holster while situated on the wearer is particularly important to accommodate the varying positions of the wearer for enhanced comfort. For instance, when the wearer is in a sitting position, the holster should be capable of being adjusted in a more forward orientation to correspond to the crease established at the hip and legs, and in an upright, downward orientation when the wearer is standing to facilitate rapid withdraw of the handgun. In addition to the feature of adjustability, the ability to completely conceal the handgun during nonuse while maintaining a level of comfort to the user is particularly advantageous to law enforcement personnel as well as others whom are required to carry or wear a full size service handgun for sustained periods of time.

Although the relevant body of the art discloses numerous devices for holding and supporting a handgun on a wearer, including those that have pivoting means to achieve a level of limited concealability and adjustability, most require the user to position his or her hands on the handgun in order to facilitate adjustment or angular positioning of the holster. This may create a potentially dangerous situation particularly if the holster is designed to pivot below or at the waistline to enhance concealability of the handgun, as seen in U.S. Pat. No. 5,265,781 issued Nov. 30, 1993 to Nichols, which shows an apparatus to allow pivotal movement of the holster, but relies in most part on the handle of the handgun to facilitate movement thereof.

Accordingly, there remains a need for a holster and mounting bracket assembly capable of being adjusted about the waistline without resorting to increased handling of the handgun while situated on the wearer, in addition to having a slim-line profile to enhance comfort and complete concealability during nonuse and storage of the handgun on the wearer.

BRIEF SUMMARY OF THE INVENTION

In order to overcome the numerous drawbacks apparent in the prior art, an improved handgun holster and mounting bracket assembly has been devised for use on a belt or strap adaptably positioned on a user.

It is thus an object of the present invention to provide a low cost, non-complicated holster and mounting bracket assembly which may be reliably used with numerous types of full size service handguns most often used by law enforcement personnel as well as other professionals whom are required to wear a full size service handgun for sustained periods of time.

It is another object of the present invention to provide such a holster and mounting bracket assembly which affords versatility in terms of functioning on a variety of body types, including means for right- and left-hand use.

It is another object of the present invention to provide such a holster and mounting bracket assembly which possess the capacity of being completely concealed on the user, while maintaining a level of comfort during nonuse and storage of the handgun on the user.

It is another object of the present invention to provide such a holster and mounting bracket assembly which comprises means to adjust the angular relationship thereof to accommodate the positioning of the wearer's arm and corresponding movement without resorting to increased handling of components comprising the handgun, particularly the handle and triggering subassemblies.

It is another object of the present invention to provide such a holster and mounting bracket assembly which comprises means to achieve a range of pivotal movement of approximately 70 degrees.

It is another object of the present invention to provide such a holster and mounting bracket assembly which adaptably raises the handgun grip above the waistline and the entire handgun approximately one inch thereabove for quick and efficient retrieval of the full size service handgun from the holster.

It is yet another object of the present invention to provide such a holster and mounting bracket assembly which accomplishes the foregoing and other objects and advantages and which is economical, durable, and fully effective in performing its intended functions.

In accordance with the present invention, an improved full size service handgun holster and mounting bracket assembly for use on a belt or strap, the assembly comprising, in combination, a handgun pouch having front and back walls substantially symmetrical and parallel to one another, a top barrel pad having a front sight channel guide to facilitate proper positioning of the handgun into the holster and removal therefrom, a pair of extending straps for securing the handgun within the handgun pouch, each extending strap comprising a free end held together by a snap fastening button, a push/pull loop having ends fixedly attached to the front and back walls to serve as means to adjust the holster without resorting to increased handling of the handgun, particularly the handle and triggering components of the handgun, a mounting bracket for pivotal movement of the holster to permit angular adjustment of the holster to correspond to the relative positioning of the wearer's arm and corresponding movement for rapid retrieval of the handgun from the handgun pouch, the mounting bracket comprising belt mounting and receiving plates, both of which form a pair of receiving pockets and thin-profiled pocket for engaging a portion of an engaging flange made part of a swivel plate to inhibit outward movement of the holster as the handgun is drawn from the handgun pouch, and right- and left-sided apertures to permit passage of a pivoting screw, the swivel plate comprising a swivel mount having a plurality of apertures extending therethrough for passage of a corresponding number of rivets to secure the handgun pouch to the swivel mount, the swivel plate further comprising an upper extending section having a pair of engaging flanges and a midsection defining a first section coplanar with the swivel mount and a second section having a locking flange to engage a portion of a middle flange made part of the receiving plate to inhibit outward movement of the swivel plate as the swivel mount and attached handgun pouch are positioned in upward orientation.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE PREFERRED EMBODIMENT

While this invention is susceptible of being embodied in many different forms, the preferred embodiment of the invention is illustrated in the accompanying drawings and described in detail hereinafter with the understanding that the present disclosure is to be considered to exemplify the principles of the present invention and is not intended to limit the invention to the embodiment illustrated. The present invention has particular utility as a device for holding and supporting a full size service handgun on a user.

Figure 1:
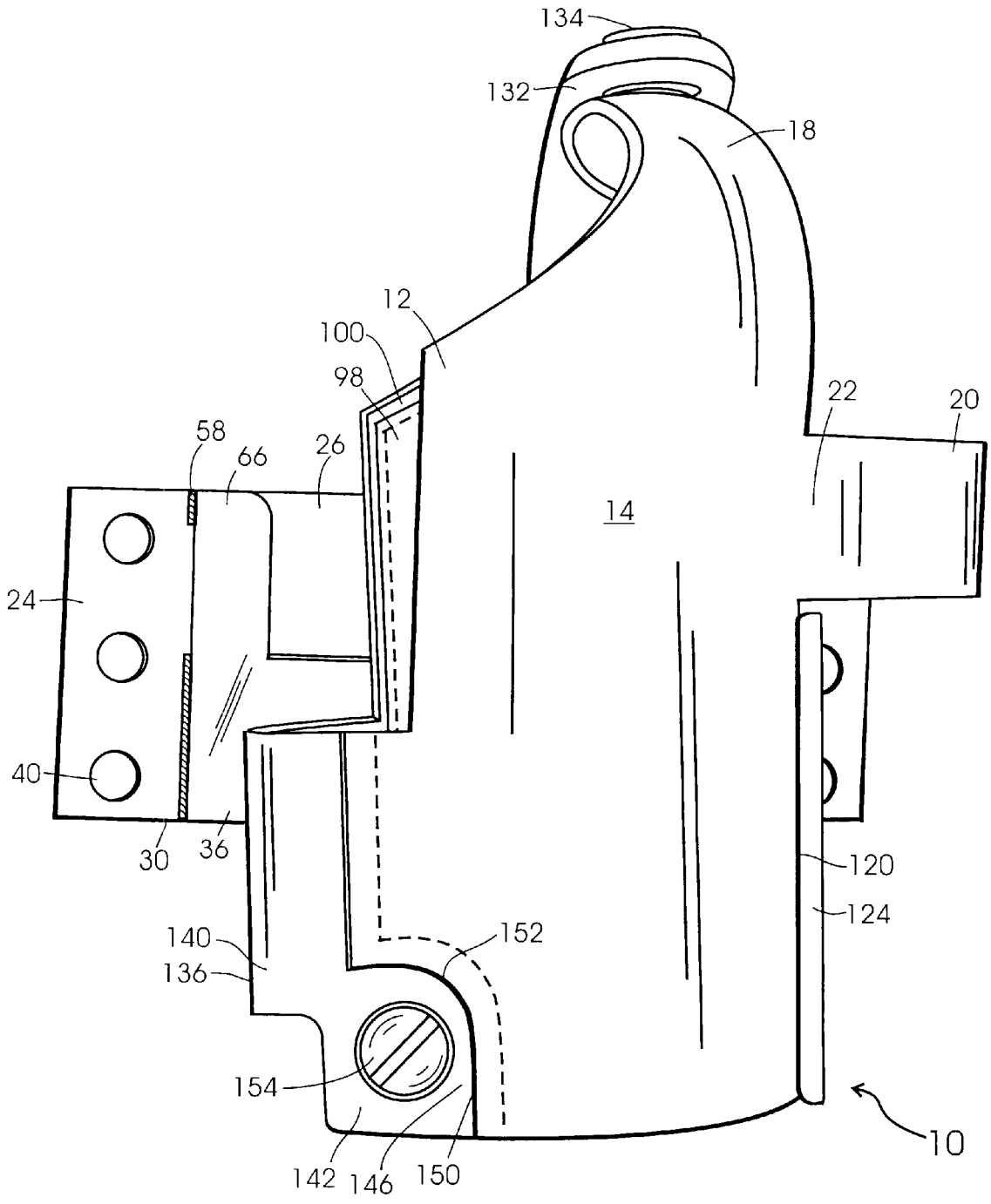
FIG. 1 is a front elevational view of the preferred embodiment of the present invention illustrating the holster attached to the mounting bracket.

Referring to FIG. 1, there is shown generally at 10 an improved holster and mounting bracket assembly for supporting and holding a full size service handgun (not shown herein) on a user, comprising, in combination a handgun pouch 12 having front and back walls 14, 16 substantially symmetrical and parallel to one another, a pair of extending straps 18 for securing the handgun within the handgun pouch, a push/pull loop 20 having ends 22 fixedly attached to the front and back walls, and a mounting bracket 24 pivotally attached to the back wall of the handgun pouch 12.

Figure 2:
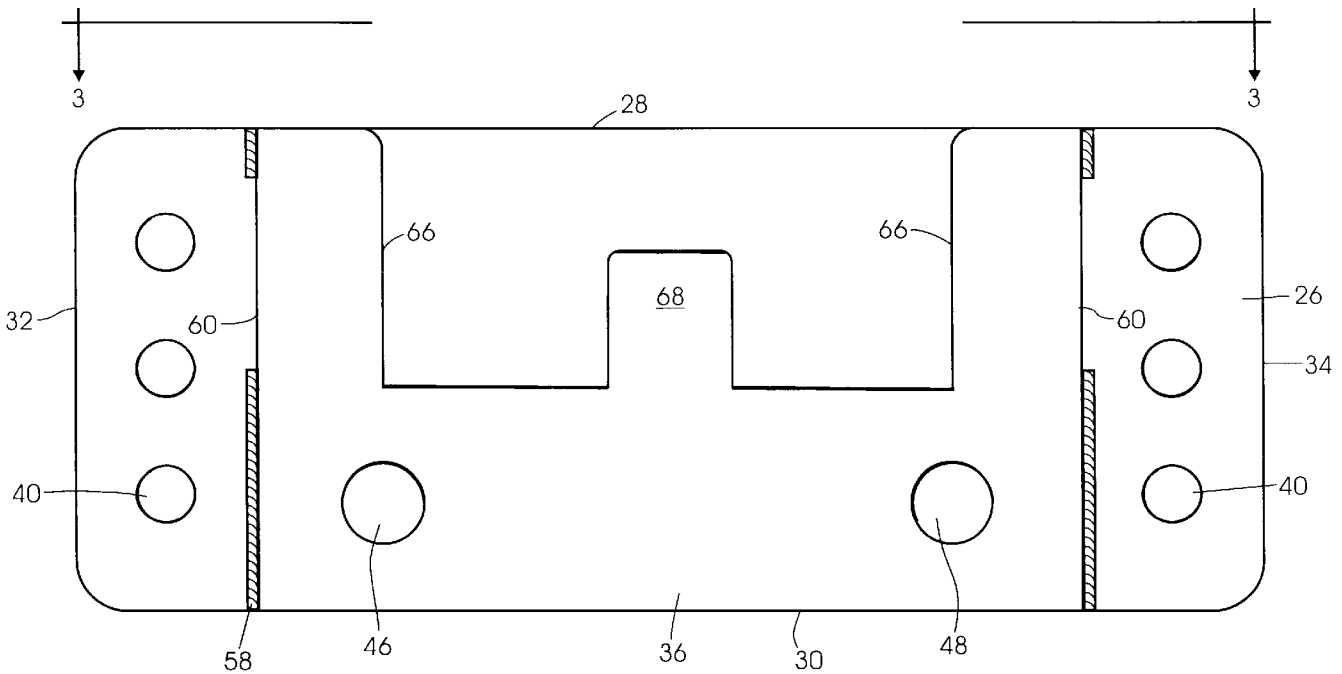
FIG. 2 is a side elevational view of the preferred embodiment of the present invention illustrating the belt mounting and receiving plates.
Figure 3:
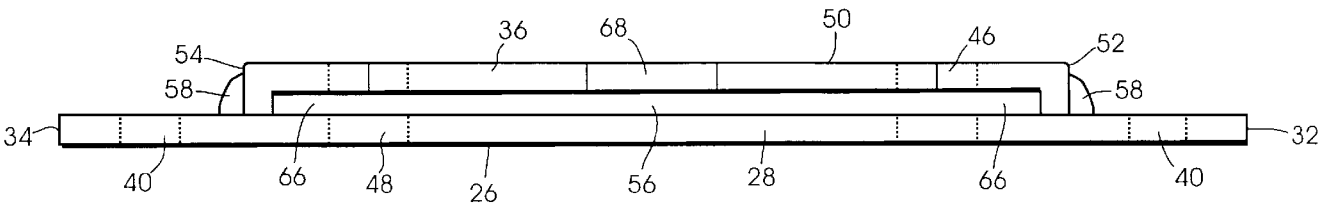
FIG. 3 is a top view of the preferred embodiment of the present invention taken on line 3—3 of FIG. 2 illustrating the belt mounting and receiving plates.
Figure 4:
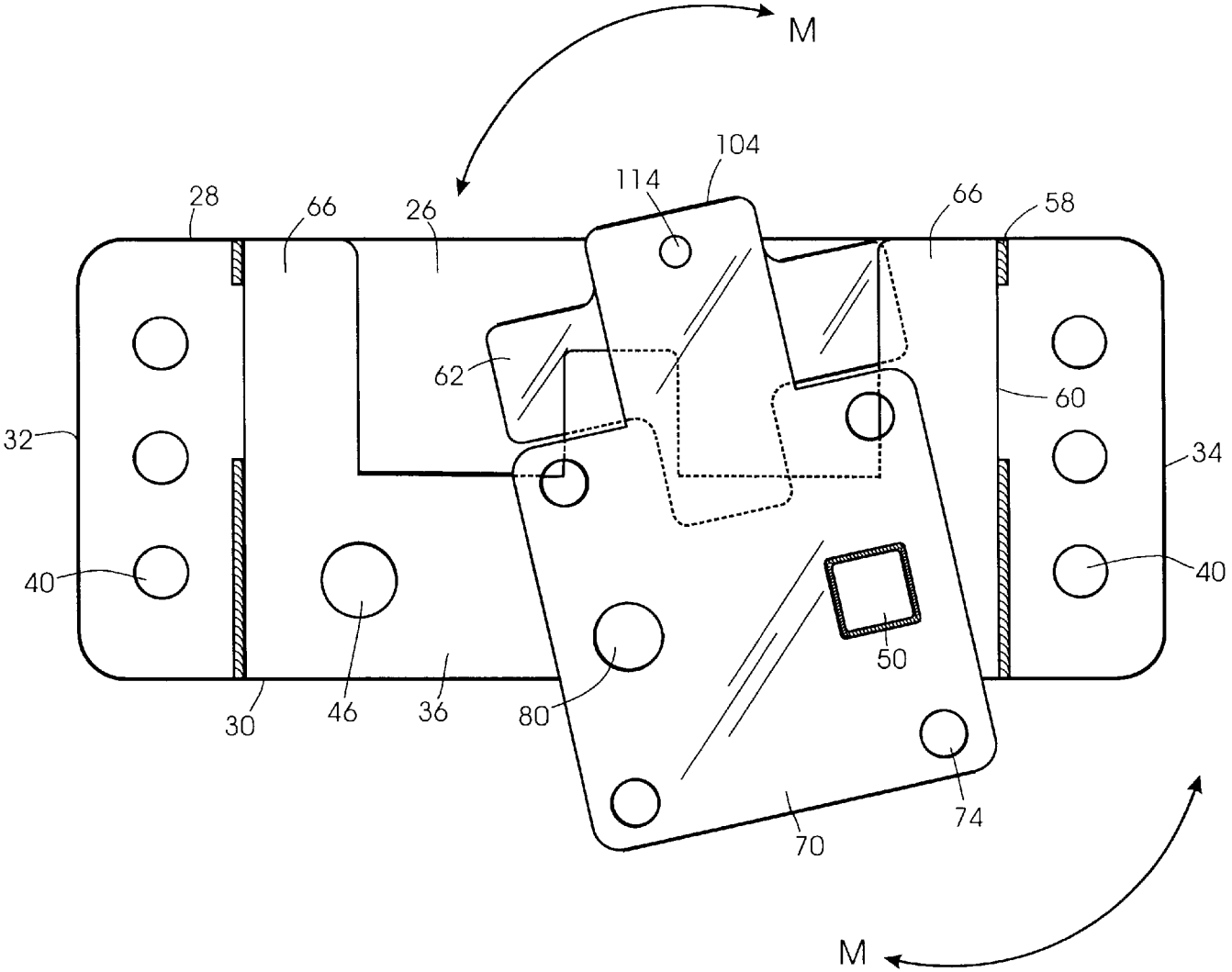
FIG. 4 is a side elevational view of the preferred embodiment of the present invention illustrating the swivel plate pivotally mounted to the belt mounting and receiving plates.

The mounting bracket preferably comprises a belt mounting plate 26 having top and bottom ends 28, 30 and a pair of opposing ends 32, 34 situated perpendicular therebetween, forming a geometric configuration substantially resembling a rectangle and a receiving plate 36 specifically configured to receive and accept a portion of a swivel plate 38. As shown in FIG. 2, the mounting bracket 26 further comprises a plurality of apertures 40 extending through the belt mounting plate 26, preferably near the opposing ends 32, 34, for mounting or securing the mounting bracket to a belt or strap 42 using rivets 44 or other securing means generally known and accepted in the art, and left- and right-positioned apertures 46, 48 extending through both the mounting and receiving plates, specifically near the bottom end 30 to permit passage of a pivoting screw 50. In the preferred embodiment, each of the opposing ends comprises three apertures generally placed in an aligned configuration and span equidistant from one another between the top and bottom ends 28, 30 of the belt mounting plate 26. The receiving plate comprises a pair of end walls 52, 54 substantially parallel to one another and perpendicular to the receiving plate and having a width slightly greater than the thickness of the swivel plate 38 to form a thin-profiled pocket 56, as best seen in FIGS. 2 and 3. In the preferred embodiment, the width of each end wall 52, 54 is sized approximately 1/16 of an inch greater than the thickness of the swivel plate 38 to provide relatively unhindered movement of the swivel plate within the thin-profiled and receiving pockets 56, 66, and generally serves as the location where the receiving plate 36 is fixedly attached to the belt mounting plate 26 using a bead of weld 58. It is desired, and therefore preferred, that each end wall 52, 54 comprise an open slot 60 having a predetermined size to accept and permit passage of a portion of a pair engaging flanges 62 made part of the swivel plate 38, as seen in FIG. 4. To maintain adequate spacing of the thin-profiled pocket 56 while the pivoting screw 50 is being tightened, particularly in the instance when the belt mounting plate 26 is attached to the handgun pouch 12, a spacer 64, preferably made from high density rubber, is fitted onto the pivoting screw 50 and is positioned between the receiving and belt mounting plates 36, 26. The receiving plate further comprises a pair of receiving pockets 66, each being defined in part by the end wall 52, 54 of the receiving plate and a middle flange 68 centrally located about the receiving plate 36, between the end walls 52, 54 and receiving pockets 66. The middle flange 68 is substantially coplanar with the receiving plate 36 and is specifically configured to engage with one of two engaging flanges 62 to lock and prevent outward movement thereof as the swivel plate 38 pivotally moves about the pivoting screw 50 and receiving and belt mounting plates 36, 26, as illustrated along path M in FIG. 4.

Figure 5:
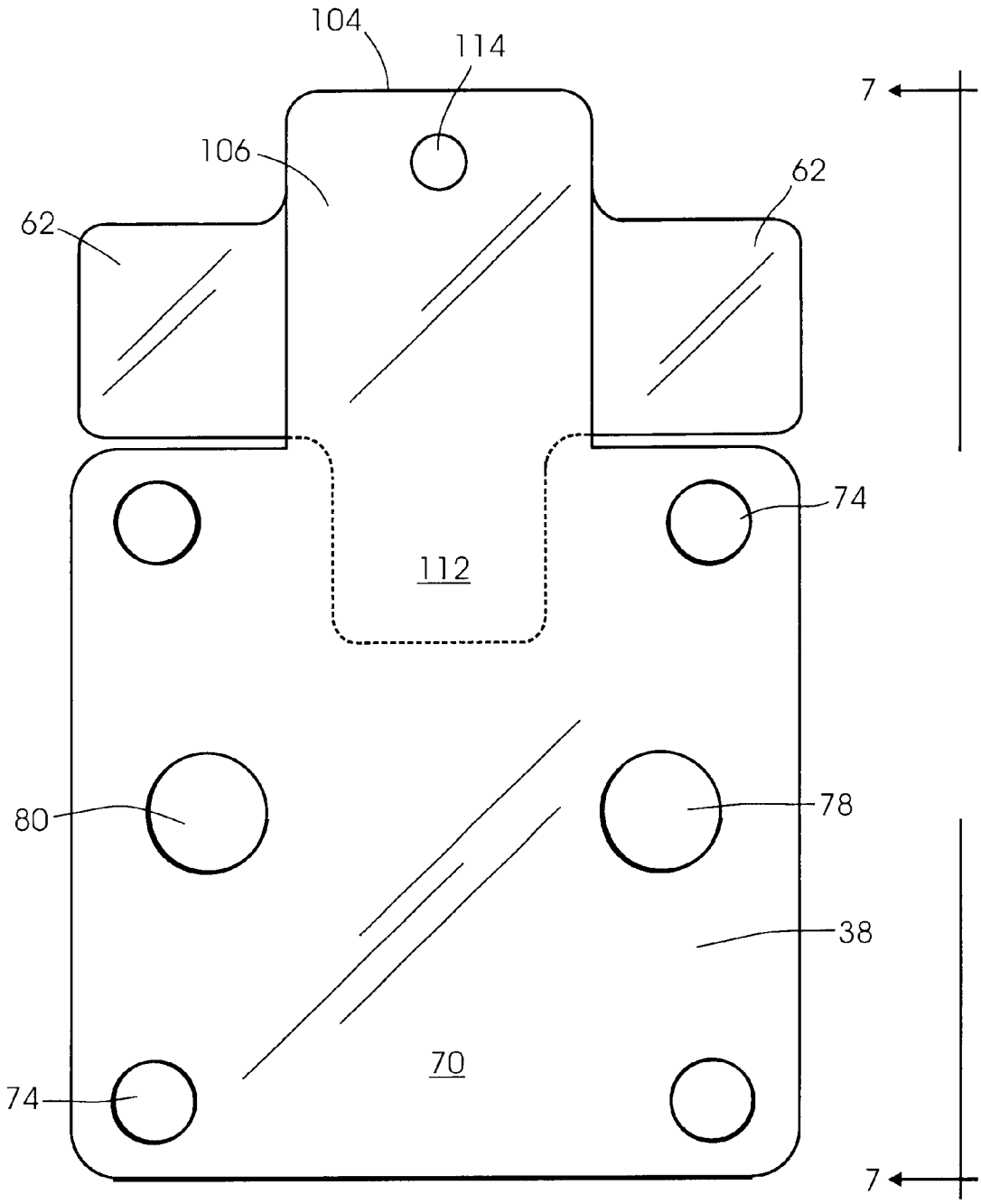
FIG. 5 is a front elevational view of the preferred embodiment of the present invention illustrating the swivel plate.
Figure 6:
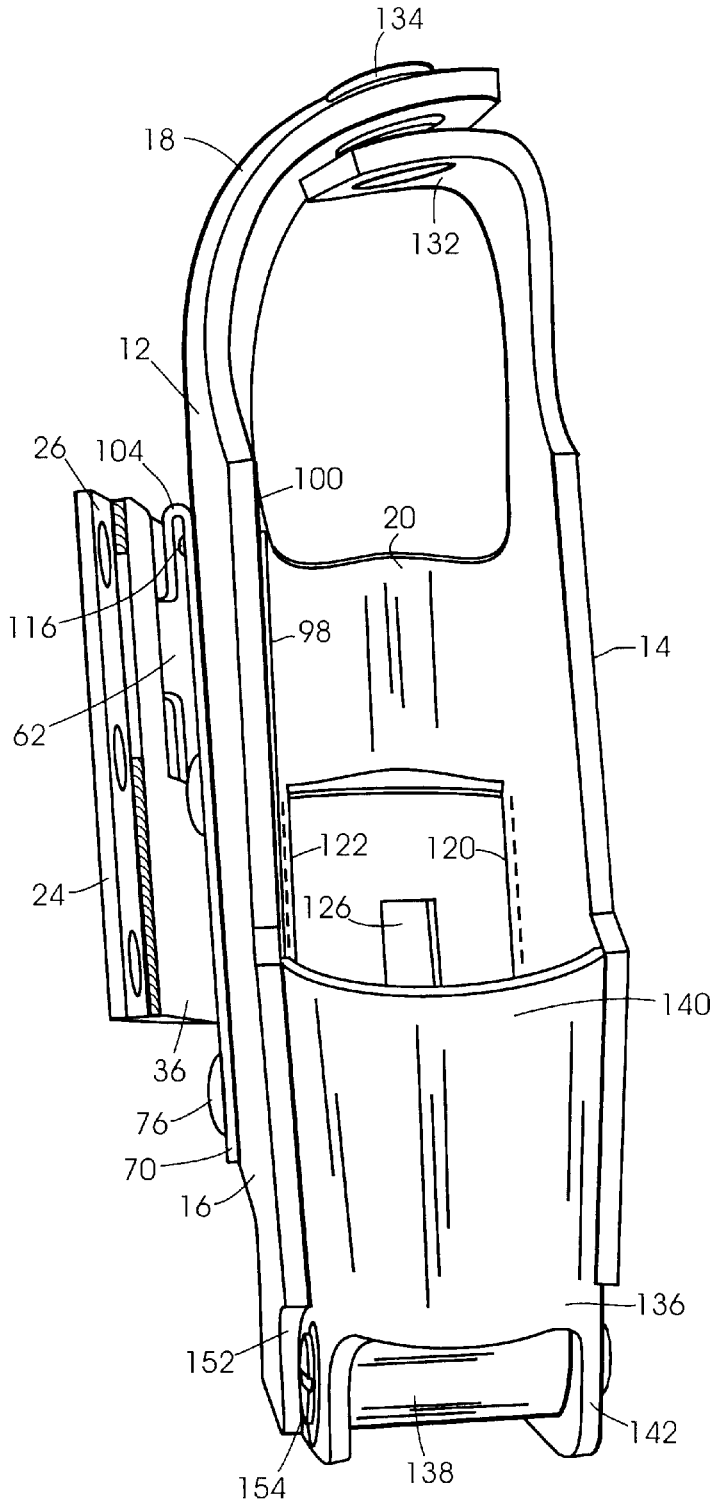
FIG. 6 is a side elevational view of the preferred embodiment of the present invention illustrating the holster attached to the mounting bracket assembly.
Figure 7:
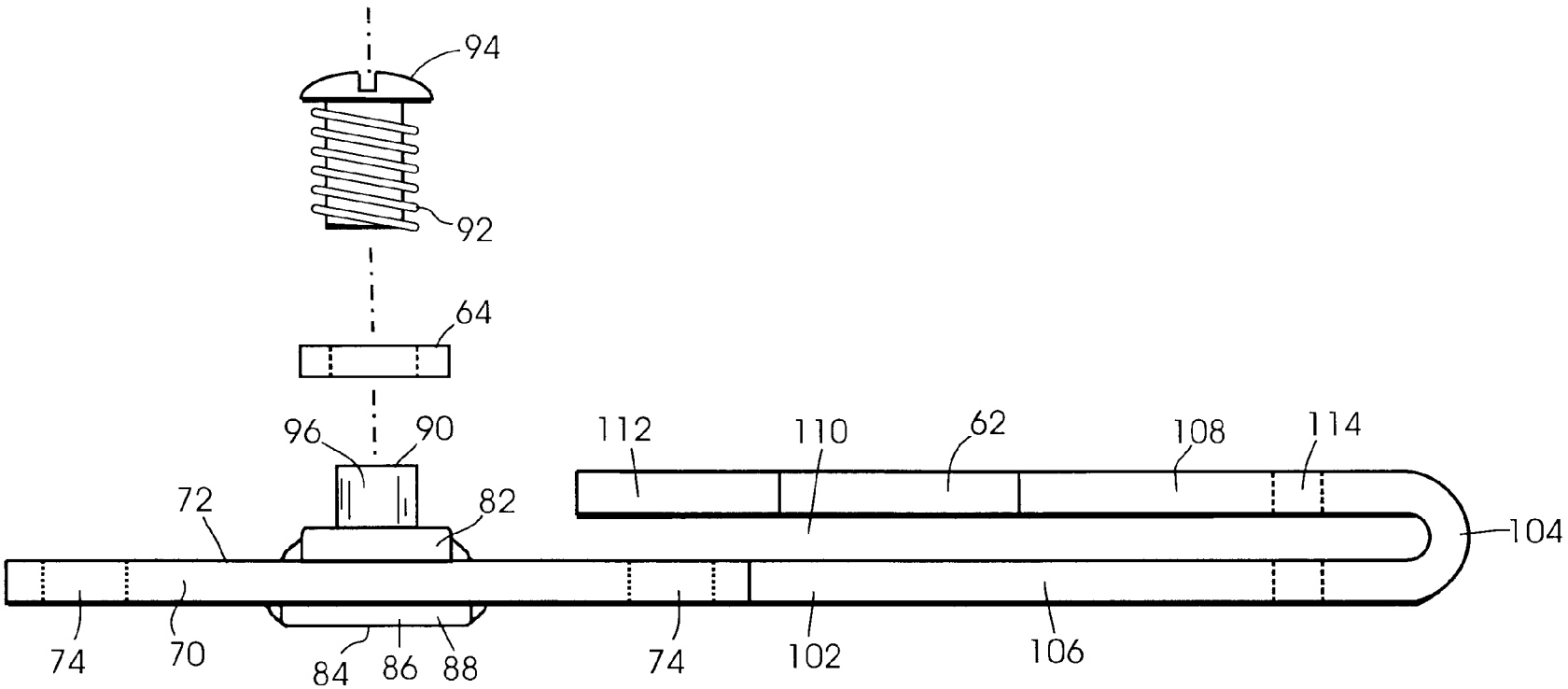
FIG. 7 is a side elevational view of the preferred embodiment of the present invention taken on line 7—7 of FIG. 5 illustrating the swivel plate without the pivoting screw assembly.

Referring now to FIGS. 4 and 5, the swivel plate 38 comprises a swivel mount 70 having a back side 72, a plurality of holster mounting apertures 74 extending therethrough for receiving a corresponding number of rivets 76 or other securing devices appreciably known in the art and a pair of right- and left-sided apertures 78, 80 to permit passage and mounting of the pivoting screw 50. The pivoting screw generally comprises a washer 82 and a T-shaped nut 84 fixedly fitted with a flattened cap 86 at one end 88 and a second end 90 for receiving a threaded portion 92 of a self-locking screw 94. Preferably, as illustrated in FIGS. 4 and 7, the flattened cap 86 is welded to the swivel plate 38 to inhibit rotation of the T-shaped nut as the self-locking screw is being threaded and tightened to the second end 90, and generally comprises a low profile configuration to ensure minimal interference and a close relationship to the holster as the handgun pouch 12 is fixedly attached to the swivel mount 70 using rivets 76, as shown in FIG. 6. The washer 82 is preferably placed over and onto a narrow cylindrical portion 96 of the T-shaped nut 84 and is positioned between the back side 72 of the swivel mount and the receiving plate 36 to maintain adequate clearance therebetween and ensure ample clearance over the rivets 76 used in securing the handgun pouch to the swivel mount. Due to the presence of rivets 76, a liner 98 made from the same material as the handgun pouch 12 is adaptably fitted to an interior side 100 of the back wall 16 of the handgun pouch 12, specifically being fitted over and covering the heads of the rivets 76 to prevent any damage to the handgun as it is drawn from and inserted within the handgun pouch. Promotion or greater resistance of pivotal travel of the swivel plate is established by accessing the self-locking screw 94 from the back of the belt or strap 42 and either loosening or tightening the self locking screw, respectively. To remove the holster from the swivel plate, the self locking screw 94 is threadably loosened and removed from the narrow cylindrical portion 96 of the T-shaped nut, as the pivoting screw serves as the only component to attach the holster to the belt. Preferably, the holster mounting apertures 74 are located near each of the four corners of the swivel mount 70 to adequately distribute and secure the swivel mount to the back wall 16 of the handgun pouch 12, as depicted in FIG. 5, while the right- and left-sided apertures 78, 80 are located approximately one-half the height of the swivel mount, with both apertures existing between a pair of holster mounting apertures 74. Regardless of the user's preference for right- or left-handed use of the holster, the strategic placement of the right- and left-sided apertures, along with the location where the swivel plate is mounted to the handgun pouch, permits the baseline height of the holster to be raised approximately one inch above the waistline as the holster is rotated about the pivoting screw 50. Situated between the pair of holster mounting apertures 74 and extending outwardly from the swivel mount 70 is an upper extending section 102 having a width substantially equivalent to one the engaging flanges 62, as illustrated in FIG. 5. The upper extending section preferably comprises a midsection 104 defining a first section 106 that is coplanar with the swivel mount 70 and a second section 108 that is substantially positioned thereabove, forming an underside space 110 at and near the back side 72 of the swivel mount, as shown in FIG. 7. The space 110 formed between the first and second sections 106, 108 is substantially equivalent to the thickness of the receiving plate 36, similar to what was described hereinbefore for the swivel plate 38, with the preferred embodiment being described as slightly greater than such thickness, approximately 1/16 of an inch, to ease sliding movement of the second section 108 of the upper extending section 102 relative to the receiving and belt mounting plates 36, 26 existing on each side thereof. The second section 108 of the upper extending section 102 further comprises a locking flange 112 having geometric configuration equivalent to one of the engaging flanges 62 and extends perpendicular to and beyond the engaging flanges to engage the middle flange 68 or a portion thereof to inhibit outward movement of the swivel plate 38 as the swivel mount 70 and attached handgun pouch 12 are positioned in upward orientation. This locking feature, combined with the locking action of the engaging flange 62 adaptably fitted into the receiving pocket 66, permits solid feel to the user and provides ready retrieval of the handgun from the handgun pouch without undue, outward movement of the holster relative to the wearer's waistline. Located near the midsection 104 of the upper extending section is a midsection aperture 114 which extends through the first and second sections 106, 108 and the underside space 110. The midsection aperture permits passage of a rivet 116 to adequately secure an upper portion 118 of the back wall of the handgun pouch 12 to the first section, particularly near the location where the end 22 of the push/pull loop 20 attaches to the handgun pouch 12, as this area receives a moderate amount of force and stress as the handgun pouch is angularly adjusted and while the handgun is periodically drawn from or inserted within the handgun pouch.

Figure 8:
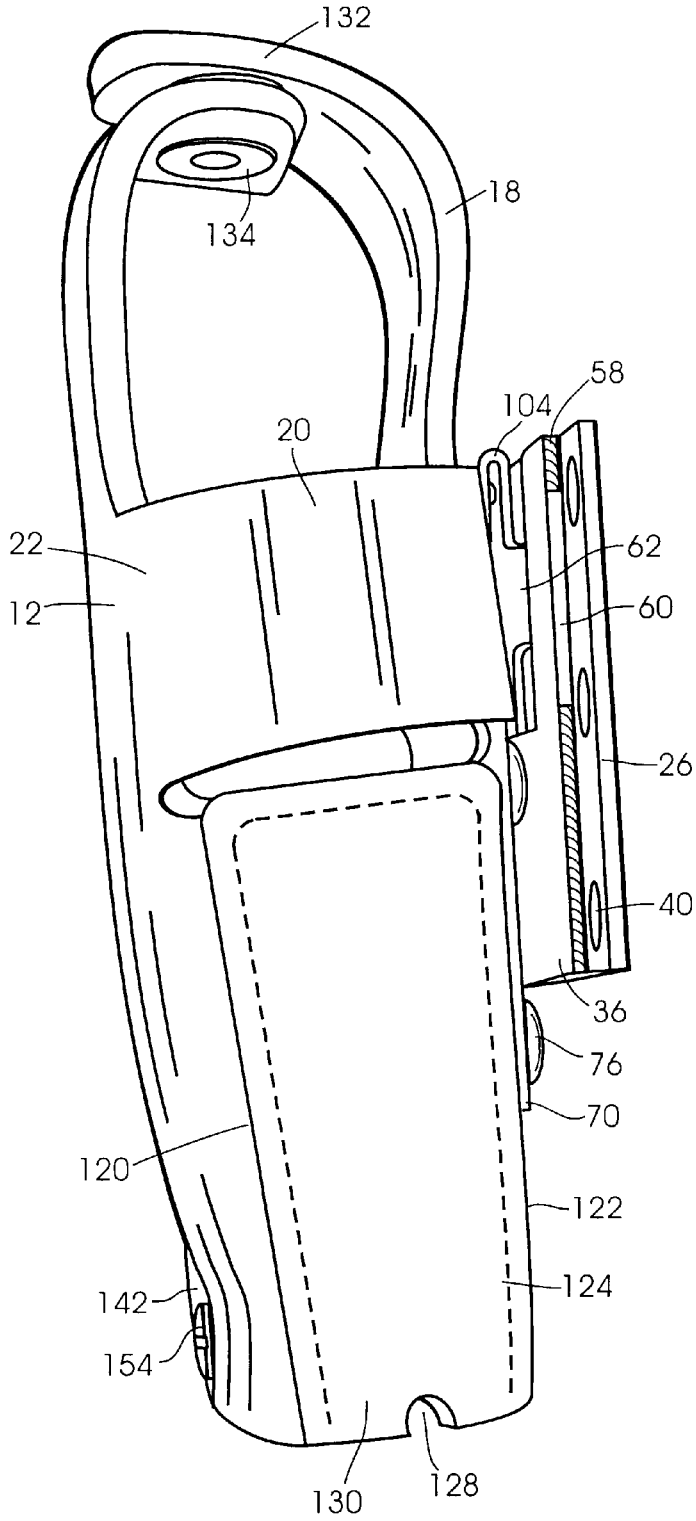
FIG. 8 is a side elevational view of the preferred embodiment of the present invention illustrating the holster mounted to the mounting bracket assembly.

Referring now to FIG. 8, each of the front and back walls 14, 16 of the handgun pouch 12 comprises forward edges 120, 122 to serve as a location to secure the back and front walls of the handgun pouch to a top barrel pad 124, which is substantially positioned near and below the push/pull loop 20. The barrel pad is preferably elongate in shape and slightly curved longitudinally to accommodate the cylindrical configuration of the handgun barrel. The barrel pad 124 further comprises a front sight channel 126 guide to accommodate the shape and geometric configuration of the handgun sight and a sight cutout 128 positioned at a lower portion 130 of the barrel pad to prevent catching of the handgun sight as the handgun is drawn from and inserted within the handgun pouch. The barrel pad 124 is particularly important to operating the holster, as it facilitates proper positioning or guiding of the handgun within the handgun pouch 12 as it is rapidly drawn or inserted therewithin by the user. In the preferred embodiment, the barrel pad 124, as well as the handgun pouch 12, is fabricated from top grain leather or similar material capable of being molded or shaped about the geometric configuration of the handgun, and is sewn to the forward edges 120, 122 of the back and front walls using high strength thread.

Figure 9:
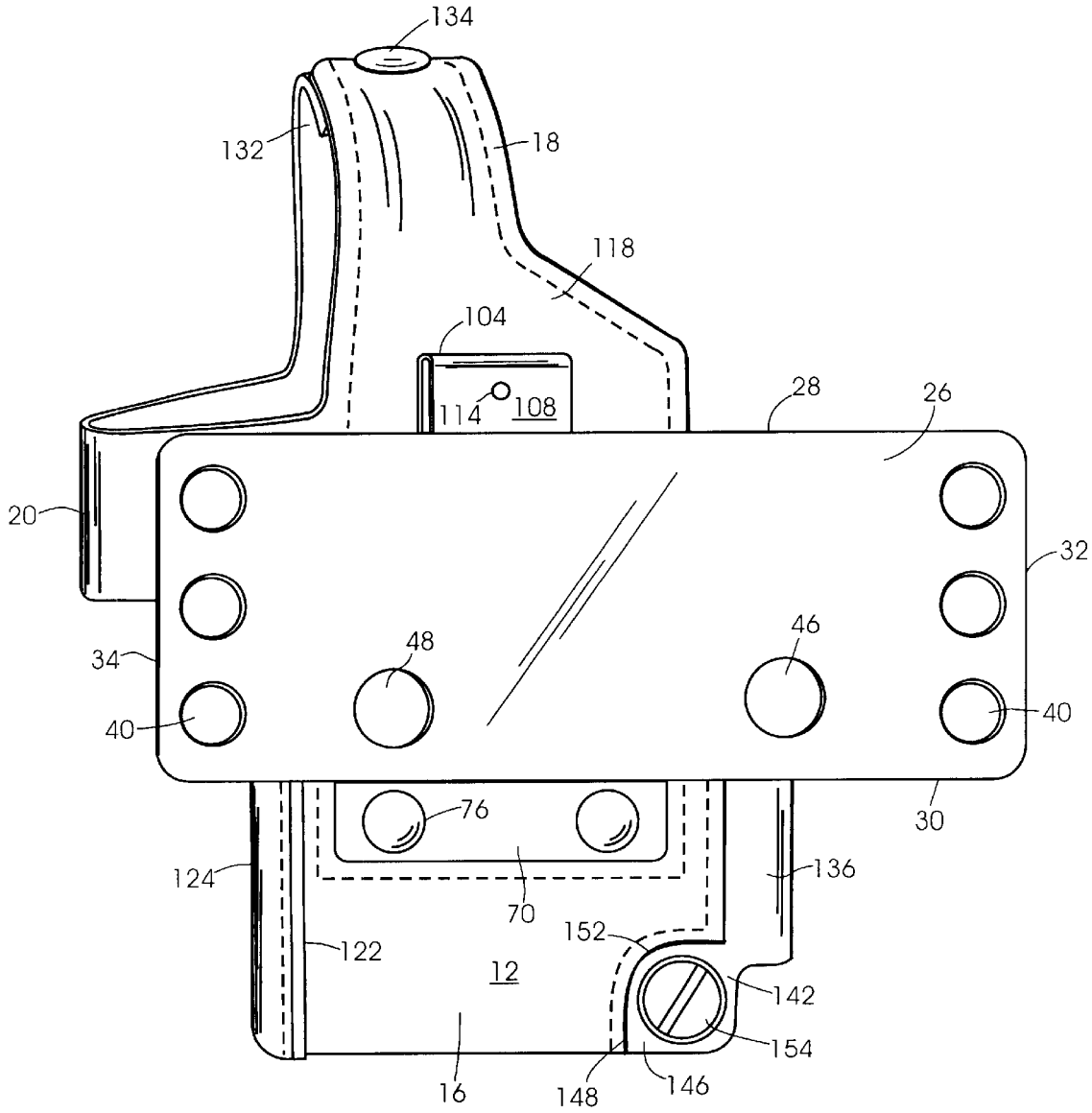
FIG. 9 is a back elevational view of the preferred embodiment of the present invention illustrating the holster attached to the mounting bracket assembly.

As illustrated in FIGS. 6, 8 and 9, the handgun pouch 12 further comprises integrally extending straps 18 which serve to secure the handgun within the handgun pouch and are configured to wrap around the butt end of the handgun, near the handgun handle. Each extending strap, having a predetermined length to ensure a secure, tight fit of the handgun within the handgun pouch, comprises a free end 132 for attaching a snap fastening button 134 for securing together the free ends of the extending straps. The use of the snap fastening button is preferred over other known fastening devices given its capability to adequately secure the handgun within the handgun pouch 12, while allowing for ready retrieval of the handgun through simple movement of the thumb, more specifically using the thumb to upwardly flick or move aside one of the free ends that overlaps the other.

Figure 10:
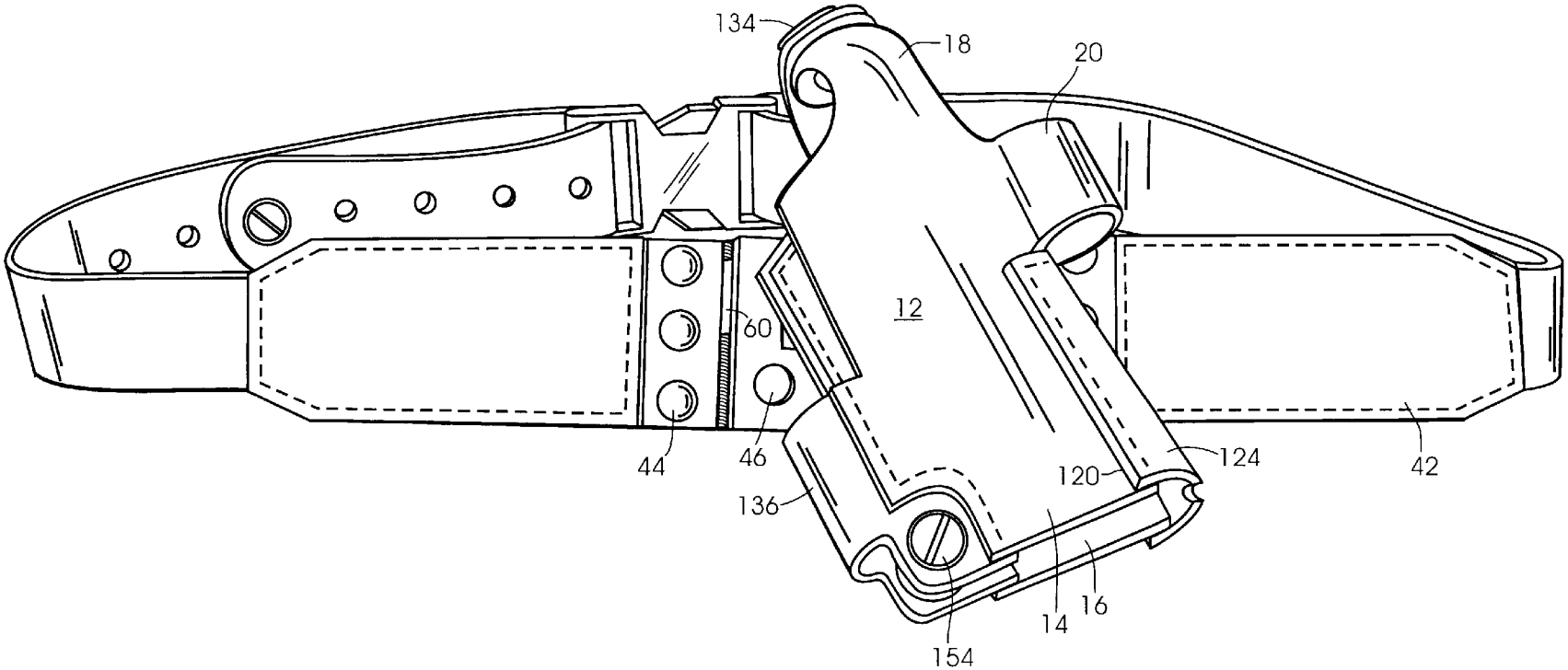
FIG. 10 is a front perspective view of the preferred embodiment of the present invention illustrating the holster and mounting assembly attached to a belt.

In addition to securing the handgun within the handgun pouch using extending straps, the handgun pouch further comprises a trigger guard support 136 having a cylindrical stop 138 for engaging a portion of a trigger guard generally made part of the handgun. In the preferred embodiment, the trigger guard support comprises an elongate curved section 140, generally corresponding to the curved configuration of the barrel pad 124, a lower portion 142 for attaching the cylindrical stop, and ends 144, 146 fixedly attached to a lower back edge 148, 150 of each of the front and back walls 14, 16. As depicted in FIGS. 1, 9 and 10, each of the back and front walls of the handgun pouch 12 further comprises a lower curved cutout 152, which permits access to a pass-through bolt 154 used to mount and dismount the cylindrical stop 138. Preferably, the cylindrical stop is positioned longitudinally between and perpendicular to the back and front walls of the handgun pouch 12 to maintain predetermined separation of the front and back walls 14, 16, generally corresponding to the dimensional width of the handgun.

In operation, the user fits the belt 42 equipped with the holster and mounting bracket 24 assembly onto the waistline. The handgun, typical of those types often used by law enforcement personnel, is slidably positioned and inserted within the handgun pouch 12 until the trigger guard of the handgun rests up against the trigger guard support 136 and cylindrical stop 138. Each extending strap 18 is then positioned onto and over the butt end of the handgun, with the free end thereof being held together by the snap fastening button 134. To permit adjustment of the holster about the wearer, the wearer simply inserts his or her thumb within the push/pull loop 20 and pushes or pulls on the loop until the desired angular orientation of the holster is established. The strategic placement of the pivoting screw 50 relative to the location where the handgun pouch 12 attaches to the swivel mount 70 permits the baseline height of the holster to be raised approximately one inch above the waistline, thus affording the user ready access to the handgun pouch for rapid withdraw of the handgun therefrom. Further, given the location of the push/pull loop 20 relative to the waistline, notwithstanding the angular orientation of the holster, the wearer can facilitate further adjustment of the holster without resorting to handling components comprising the handgun, which may alleviate a potentially dangerous situation as one is in need of rapid retrieval of the handgun. To achieve greater resistance to or ease pivotal movement of the holster about the pivoting screw 50, the self locking screw 94 is tightened or loosened, respectively.

It can be seen from the foregoing that there is provided in accordance with this invention a simple and easily operated device, which is particularly suitable for use by law enforcement personnel and other professionals whom are required to wear a handgun for sustained periods of time. The holster and mounting bracket assembly is completely functional in terms of accommodating the wearer's body type for enhanced, long-term comfort and concealing the handgun during sustained periods of nonuse and storage on the wearer.

It is obvious that the components comprising the handgun pouch 12 may be fabricated from a variety of materials, providing such selection or use of materials possess the capacity of withstanding moderate forces and stresses that may be encountered as the user periodically retrieves the handgun from the holster or makes adjustment thereto during use. It is most desirable, and therefore preferred, to construct the handgun pouch from top grain leather to ensure long-term wear, and the components comprising the mounting bracket 24 from stainless steel to ensure sustained operation and reliability.

While there has been shown and described a particular embodiment of the invention, it will be obvious to those skilled in the art that various changes and alterations can be made therein without departing from the invention and, therefore, it is aimed in the appended claims to cover all such changes and alterations as fall within the true spirit and scope of the invention.

What is claimed is:

1. An improved holster and mounting bracket assembly for use on a belt or strap made adaptable to support and hold a handgun on a wearer, comprising, in combination:

a handgun pouch having front and back walls substantially symmetrical and parallel to one another, each of said back and front walls comprising a forward edge to serve as a location to connect a top barrel pad thereto and a lower back edge to serve as a location to connect a trigger guard support thereto;

a push/pull loop integrally connected to said forward edges of said back and front walls to facilitate angular adjustment of said holster without resorting to increased handling of components comprising the handgun;

a mounting bracket comprising a belt mounting plate to serve as means to secure said holster to the belt or strap and a receiving plate having a pair of end walls fixedly attached to said belt mounting plate to a form a pair of receiving pockets and a thin-profiled pocket to receive a portion of an engaging flange to lock and prevent inadvertent outward movement of said holster as the handgun is drawn from said handgun pouch; and a swivel plate comprising a swivel mount pivotally attached to said belt mounting and receiving plates using a pivoting screw, said swivel mount being substantially positioned within said thin-profiled pocket and comprising swivel attachment means for attaching said handgun pouch to said swivel plate and means for inhibiting outward movement of said holster as the handgun is drawn from said handgun pouch.

2. An improved holster and mounting bracket assembly as set forth in claim 1, wherein said swivel attachment means comprises a plurality of holster mounting apertures extending through said swivel mount to permit passage of a corresponding number of rivets, said mounting apertures being substantially located at the corners of said swivel mount to secure and prevent outward movement of said handgun pouch as the handgun is rapidly retrieved therefrom.

3. An improved holster and mounting bracket assembly as set forth in claim 2, wherein said back wall of said handgun pouch comprises an interior side having a liner adaptably fitted thereto to protect the handgun from damage due to the presence of rivets used in securing said handgun pouch to said swivel mount.

4. An improved holster and mounting bracket assembly as set forth in claim 1, wherein said outwardly inhibiting means comprises an upper extending section extending from said swivel mount and having a midsection defining first and second sections, said second section comprising a locking flange extending therefrom to engage a middle flange made part of said receiving plate to inhibit and prevent outward movement of said holster as said handgun pouch is positioned in a vertical orientation, said first section being co-planer with said swivel mount and being positioned below said first section forming an underside space at and near a backside of said swivel plate to accept a portion of said receiving plate.

5. An improved holster and mounting bracket assembly as set forth in claim 4, wherein said upper extending section further comprises a midsection aperture extending through first and second sections to permit passage of a rivet to further fasten and secure said swivel mount to said handgun pouch to inhibit outward movement of said holster as the handgun is drawn therefrom.

6. An improved holster and mounting bracket assembly as set forth in claim 1, wherein said top barrel pad comprises a front sight channel guide geometrically configured to correspond to the handgun's barrel and integral sight and a sight cutout positioned at a lower portion of said barrel pad to prevent inadvertent catching of the handgun's barrel and sight as the handgun is drawn from and inserted into said handgun pouch.

7. An improved holster and mounting bracket assembly as set forth in claim 1, wherein said trigger guard support further comprises a cylindrical stop for engaging a portion of a trigger guard generally made part of the handgun, said trigger guard support comprising an elongate curved section and a lower portion, said cylindrical stop being mounted near said lower portion and having ends fixedly attached to said lower back edge of each of said back and front walls using a pass-through bolt made accessible by a lower curved cutout integrally made part of said back and front walls of said handgun pouch.

8. An improved holster and mounting bracket assembly as set forth in claim 7, wherein said cylindrical stop is positioned longitudinally between and perpendicular to said back and front walls of said handgun pouch to maintain predetermined separation of said back and front walls, generally corresponding to the dimensional width of the handgun.

9. An improved holster and mounting bracket assembly as set forth in claim 1, wherein said handgun pouch further comprises a pair of integrally extending straps to secure the handgun within said handgun pouch, each of said extending straps comprising a free end for attaching a snap fastening button for securing together said free ends of said extending straps, said snap fastening button being substantially located at each of said free ends to allow for ready release of said extending straps from one another through simple movement of the user's thumb, more specifically enabling the user's thumb to upwardly flick or move aside one of said free ends that overlaps the other.

10. An improved holster and mounting bracket assembly as set forth in claim 1, wherein said pivoting screw comprises a washer and a T-shaped nut fixedly fitted with a flattened cap at one end and a second end for receiving a threaded portion of a self-locking screw, said flattened cap being fixedly attached to said swivel plate to inhibit rotation of said T-shaped nut as said self-locking screw is being threaded to said second end, said washer being positioned over and onto a narrow cylindrical portion of said T-shaped nut and located between said swivel mount and said receiving plate to maintain adequate clearance therebetween and ensure ample clearance over a plurality of rivets used in securing said handgun pouch to said swivel mount.

11. An improved holster and mounting bracket assembly as set forth in claim 10, wherein said pivoting screw further comprises a spacer adaptably fitted onto said narrow cylindrical portion of said T-shaped nut and positioned between said mounting and receiving plates to maintained adequate distance therebetween as said self-locking screw is tightened to increase the resistance of pivotal travel of said swivel mount about said pivoting screw.

12. An improved holster and mounting bracket assembly as set forth in claim 1, wherein said belt mounting plate comprises top and bottom ends and a pair of opposing ends situated perpendicular therebetween, said mounting plate further comprising a plurality of apertures extending therethrough for passage of a corresponding number of rivets used to secure said mounting bracket to the belt or strap, said mounting bracket further comprising left- and right-positioned apertures extending through said mounting and receiving plates and being in alignment with either a left- or right-sided aperture of said swivel mount, depending on the user's preference for left- or right-handed use of said holster.

13. An improved holster and mounting bracket assembly as set forth in claim 1, wherein each of said end walls of said receiving plate is welded to said mounting plate and comprises an open slot having a predetermined size to accept and permit passage of a portion of said engaging flange to further lock said swivel mount to said mounting bracket as said handgun pouch is angularly adjusted and positioned on the user.

14. An improved holster and mounting bracket assembly for use on a belt or strap made adaptable to support and hold a full size service handgun on a wearer, comprising, in combination:

a handgun pouch having front and back walls substantially symmetrical and parallel to one another, each of said back and front walls being held together and separated from one another by a top barrel pad and a trigger guard support, said top barrel pad comprising a front sight channel guide geometrically configured to correspond to the handgun's barrel and integral sight and a sight cut out positioned at a lower portion of said barrel pad to prevent inadvertent catching of the handgun's barrel and integral sight as the handgun is drawn from and inserted into said handgun pouch, said handgun pouch further comprising a pair of integrally extending straps to secure the handgun within said handgun pouch, each of said extending straps having a free end for attaching a snap fastening button used in securing together said free ends of said extending straps;

a push/pull loop integrally connected to said forward edges of said back and front walls to facilitate angular adjustment of said holster without resorting to increased handling of components comprising the handgun;

a mounting bracket comprising a belt mounting plate to serve as means to secure said holster to said belt and a receiving plate having a pair of end walls fixedly attached to said belt mounting plate to a form a pair of receiving pockets and a thin-profiled pocket to receive a portion of an engaging flange to lock and prevent inadvertent outward movement of said holster as the handgun is drawn from said handgun pouch; and a swivel plate comprising a swivel mount pivotally attached to said belt mounting and receiving plates using a pivoting screw, said swivel mount being substantially positioned within said thin-profiled pocket and comprising a plurality of holster mounting apertures extending therethrough to permit passage of a corresponding number of rivets, said mounting apertures being substantially located at the corners of said swivel mount to secure and prevent outward movement of said handgun pouch as the handgun is rapidly retrieved therefrom and an upper extending section extending from said swivel mount and having a mid-section defining first and second sections, said second section comprising a locking flange extending therefrom to engage a middle flange made part of said receiving plate to inhibit and prevent outward movement of said holster as said handgun pouch is positioned in a vertical orientation, said first section being co-planer with said swivel mount and being positioned below said first section forming an underside space at and near a backside of said swivel plate to accept a portion of said receiving plate, said upper extending section further comprising a midsection aperture extending through first and second sections to permit passage of a rivet to further fasten and secure said swivel mount to said handgun pouch to inhibit outward movement of said holster as the handgun is drawn therefrom.

15. An improved holster and mounting bracket assembly as set forth in claim 14, wherein said trigger guard support further comprises a cylindrical stop for engaging a portion of a trigger guard generally made part of the handgun, said trigger guard support comprising an elongate curved section and a lower portion, said cylindrical stop being mounted near said lower portion and having ends fixedly attached to said back and front walls through use of a pass-through bolt made accessible by a lower curved cutout integrally made part of said back and front walls of said handgun pouch.

16. An improved holster and mounting bracket assembly as set forth in claim 14, wherein said pivoting screw comprises a washer and a T-shaped nut fixedly fitted with a flattened cap at one end and a second end for receiving a threaded portion of a self-locking screw, said flattened cap being fixedly attached to said swivel plate to inhibit rotation of said T-shaped nut as said self-locking screw is being threaded to said second end, said washer being positioned over and onto a narrow cylindrical portion of said T-shaped nut and located between said swivel mount and said receiving plate to maintain adequate clearance therebetween and ensure ample clearance over a plurality of rivets used in securing said handgun pouch to said swivel mount.

17. An improved holster and mounting bracket assembly as set forth in claim 16, wherein said pivoting screw further comprises a spacer adaptably fitted onto said narrow cylindrical portion of said T-shaped nut and positioned between said mounting and receiving plates to maintained adequate distance therebetween as said self-locking screw is tightened to increase the resistance of pivotal travel of said swivel mount about said pivoting screw.

18. An improved holster and mounting bracket assembly as set forth in claim 14, wherein said handgun pouch is fabricated from top grain leather and said mounting bracket is fabricated from stainless steel.

19. An improved holster and mounting bracket assembly as set forth in claim 14, wherein said belt mounting plate comprises top and bottom ends and a pair of opposing ends situated perpendicular therebetween, said mounting plate further comprising a plurality of apertures extending therethrough for passage of a corresponding number of rivets used to secure said mounting bracket to the belt or strap, said mounting bracket further comprising left- and right-positioned apertures extending through said mounting and receiving plates and being in alignment with either a left- or right-sided aperture of said swivel mount, depending on the user's preference for left- or right-handed use of said holster.

20. An improved holster and mounting bracket assembly for use on a belt or strap made adaptable to support and hold a full size service handgun on a wearer, comprising, in combination:

a handgun pouch having front and back walls substantially symmetrical and parallel to one another, each of said back and front walls being held together and separated from one another by a top barrel pad and a trigger guard support, said top barrel pad comprising a front sight channel guide geometrically configured to correspond to the handgun's barrel and integral sight and a sight cut out positioned at a lower portion of said barrel pad to prevent inadvertent catching of the handgun's barrel and integral sight as the handgun is drawn from and inserted into said handgun pouch, said handgun pouch further comprising a pair of integrally extending straps to secure the handgun within said handgun pouch, each of said extending straps having a free end for attaching a snap fastening button used in securing together said free ends of said extending straps, said trigger guard support comprising a cylindrical stop for engaging a portion of a trigger guard generally made part of the handgun, an elongate curved section and a lower portion, said cylindrical stop being mounted near said lower portion and having ends fixedly attached to said back and front walls using a pass-through bolt made accessible by a lower curved cutout integrally made part of said back and front walls of said handgun pouch;

a push/pull loop integrally connected to said forward edges of said back and front walls to facilitate angular adjustment of said holster without resorting to increased handling of components comprising the handgun;

a mounting bracket comprising a belt mounting plate to serve as means to secure said holster to said belt and a receiving plate having a pair of end walls fixedly attached to said belt mounting plate to a form a pair of receiving pockets and a thin-profiled pocket to receive a portion of an engaging flange to lock and prevent inadvertent outward movement of said holster as the handgun is drawn from said handgun pouch, said belt mounting plate comprising top and bottom ends, a pair of opposing ends situated perpendicular therebetween, and a plurality of apertures extending therethrough for passage of a corresponding number of rivets used to secure said mounting bracket to the belt or strap, said mounting bracket further comprising left- and right-positioned apertures extending through said mounting and receiving plates and being in alignment with either a left- or right-sided aperture of a swivel plate, depending on the user's preference for left- or right-handed use of said holster, said swivel plate comprising a swivel mount pivotally attached to said belt mounting and receiving plates using a pivoting screw, said swivel mount being substantially positioned within said thin-profiled pocket and comprising a plurality of holster mounting apertures extending therethrough to permit passage of a corresponding number of rivets, said mounting apertures being substantially located at the corners of said swivel mount to secure and prevent outward movement of said handgun pouch as the handgun is rapidly retrieved therefrom and an upper extending section extending from said swivel mount and having a midsection defining first and second sections, said second section comprising a locking flange extending therefrom to engage a middle flange made part of said receiving plate to inhibit and prevent outward movement of said holster as said handgun pouch is positioned in a vertical orientation, said first section being co-planer with said swivel mount and being positioned below said first section forming an underside space at and near a backside of said swivel plate to accept a portion of said receiving plate, said pivoting screw comprising a washer and a T-shaped nut fixedly fitted with a flattened cap at one end and a second end for receiving a threaded portion of a self-locking screw, said flattened cap being fixedly attached to said swivel plate to inhibit rotation of said T-shaped nut as said self-locking screw is being threaded to said second end, said washer being positioned over and onto a narrow cylindrical portion of said T-shaped nut and located between said swivel mount and said receiving plate to maintain adequate clearance therebetween and ensure ample clearance over said rivets used in securing said handgun pouch to said swivel mount, said pivoting screw further comprising a spacer adaptably fitted onto said narrow cylindrical portion of said T-shaped nut and positioned between said mounting and receiving plates to maintained adequate distance therebetween as said self-locking screw is tightened to increase the resistance of pivotal travel of said swivel mount about said pivoting screw.

21. A mounting bracket assembly made adaptable for use on a belt or strap to support and hold a handgun holster, comprising, in combination:

a mounting bracket comprising a belt mounting plate to serve as means to secure the holster to the belt or strap and a receiving plate having a pair of end walls fixedly attached to said belt mounting plate to a form a pair of receiving pockets and a thin-profiled pocket to receive a portion of an engaging flange to lock and prevent inadvertent outward movement of the holster as the handgun is drawn therefrom, said belt mounting plate comprising top and bottom ends, a pair of opposing ends situated perpendicular therebetween, and a plurality of apertures extending therethrough for passage of a corresponding number of rivets used to secure said mounting bracket to the belt or strap, said mounting bracket further comprising left- and right-positioned apertures extending through said mounting and receiving plates and being in alignment with either a left- or right-sided aperture integrally made part of a swivel plate, depending on the user's preference for left- or right-handed use of said holster, said swivel plate comprising a swivel mount pivotally attached to said belt mounting and receiving plates using a pivoting screw, said swivel mount being substantially positioned within said thin-profiled pocket and comprising a plurality of holster mounting apertures extending therethrough to permit passage of a corresponding number of rivets, said mounting apertures being substantially located at the corners of said swivel mount to secure and prevent outward movement of the holster as the handgun is rapidly retrieved therefrom and an upper extending section extending from said swivel mount and having a midsection defining first and second sections, said second section comprising a locking flange extending therefrom to engage a middle flange made part of said receiving plate to inhibit and prevent outward movement of the holster as it is positioned in a vertical orientation, said first section being co-planer with said swivel mount and being positioned below said first section forming an underside space at and near a backside of said swivel plate to accept a portion of said receiving plate, said pivoting screw comprising a washer and a T-shaped nut fixedly fitted with a flattened cap at one end and a second end for receiving a threaded portion of a self-locking screw, said flattened cap being fixedly attached to said swivel plate to inhibit rotation of said T-shaped nut as said self-locking screw is being threaded to said second end, said washer being positioned over and onto a narrow cylindrical portion of said T-shaped nut and located between said swivel mount and said receiving plate to maintain adequate clearance therebetween and ensure ample clearance over said rivets used in securing the holster to said swivel mount, said pivoting screw further comprising a spacer adaptably fitted onto said narrow cylindrical portion of said T-shaped nut and positioned between said mounting and receiving plates to maintained adequate distance therebetween as said self-locking screw is tightened to increase the resistance of pivotal travel of said swivel mount about said pivoting screw.

* * * * *